US005482509A

United States Patent [19]

Dull

[11] Patent Number: 5,482,509

[45] Date of Patent: Jan. 9, 1996

[54] LOTTERY PLAY SLIP AND LOTTERY TICKET JACKET

[76] Inventor: David L. Dull, 6415 Midnight Pass Rd., C-1, Sarasota, Fla. 34242

[21] Appl. No.: 435,670

[22] Filed: May 5, 1995

[51] Int. Cl.[6] ..... B42D 15/00

[52] U.S. Cl. ..... 462/64; 283/116; 283/903

[58] Field of Search ..... 281/45, 51; 462/64, 462/65; 283/56, 109, 116, 117, 903

[56] References Cited

U.S. PATENT DOCUMENTS

| | | | |
|---|---|---|---|
| Re. 17,468 | 10/1929 | Osborn . | |
| 3,958,690 | 5/1976 | Gee, Sr. | 283/900 X |
| 4,643,451 | 2/1987 | Coates | 462/64 X |
| 4,654,923 | 4/1987 | Faclane et al. | 283/903 X |
| 4,716,948 | 1/1988 | Brissette . | |
| 4,781,379 | 11/1988 | Parks . | |
| 4,909,383 | 3/1990 | Gross . | |
| 5,031,763 | 7/1991 | Lynam . | |
| 5,080,223 | 1/1992 | Mitsuyama . | |

FOREIGN PATENT DOCUMENTS

| | | | |
|---|---|---|---|
| 2721968 | 11/1978 | Germany | 283/903 |

*Primary Examiner*—Willmon Fridie, Jr.
*Attorney, Agent, or Firm*—Charles J. Prescott

[57] ABSTRACT

A lottery play slip and lottery ticket jacket for protectively holding one or a plurality of play slips and lottery tickets. The device is formed of three preferably transparent flat panels connected along three edges one to another. The forth or upper margin of each panel is unconnected to facilitate slidable insertion of the play slip between two of the panels sized similar to the play slip and insertion of the smaller lottery ticket between the second and third panels, the third panel being smaller in size and similar to that of the lottery ticket.

3 Claims, 1 Drawing Sheet

26
16
28
A
22
10
18
30
20
B
52
48
40
56
42
54
50
44

58
46
28
A
12
10
26
24

14
28
10
A
22
16
12
18
20
B
14
24

66
60
67
62
68
64
64a
69
68
64
66
64a
60

68
67
62
64
64a
60
69

72
70
74
78
80
82
84

76

LOTTERY PLAY SLIP AND LOTTERY TICKET JACKET

BACKGROUND OF THE INVENTION

1. Scope of Invention

This invention relates generally to protective jackets for enclosing and holding flat objects, and more particularly to a protective jacket for holding and displaying lottery play slips and lottery tickets.

2. Prior Art

Millions of people purchase lottery tickets each week in the United States and throughout the world. In Florida and in other locations, a participant first makes one or more sets of number selections by marking the appropriate boxes contained on a lottery play slip. Filling in those tiny boxes for each correct number is tedious and time-consuming. That play slip is then turned over to a lottery ticket outlet, along with the appropriate lottery ticket charge, and used to automatically produce a lottery ticket with each of the sets of selected numbers printed thereon. Thereafter, both the lottery play slip and the lottery ticket are given to the participant.

In many circumstances, a participant may wish to play these same "lucky" numbers chosen on a particular lottery play slip on a weekly basis for a period of time. Because the play slips are fabricated of paper, they will rapidly deteriorate from one week to the next as they are carried by the participant and then presented to produce a lottery ticket having these same "lucky" numbers. If the play slip has become too worn or tattered, the participant must fill out a new play slip.

Additionally, a participant will typically select more than one set of play numbers and will then purchase and receive several lottery tickets, each representing a different lottery number set chosen. Safe storage of these lottery tickets is obviously an important function of this play process so that, should a participant be lucky enough to have selected the winning numbers, the lottery ticket is readily available for claiming the prize.

Presently, nothing known to applicant is available which will both protectively hold the lottery play slips for repeated weekly use, and/or hold one or more lottery tickets until winning numbers are selected. The present invention provides such a device which, in its preferred transparent embodiment, will both protectively house one or a plurality of lottery play slips for reuse, as well as protectively hold one or a plurality of lottery tickets, the device being easily carryable in a purse or pocket of each lottery participant.

BRIEF SUMMARY OF THE INVENTION

This invention is directed to a lottery play slip and lottery ticket jacket for protectively holding one or a plurality of play slips and lottery tickets. The device is formed of three preferably transparent flat panels connected along three edges one to another. The forth or upper margin of each panel is unconnected to facilitate slidable insertion of the play slip between two of the panels sized similar to the play slip and insertion of the smaller lottery ticket between the second and third panels, the third panel being smaller in size and similar to that of the lottery ticket.

It is therefore an object of this invention to provide a lottery play slip and lottery ticket jacket or holder which will protectively enclose and hold one or a plurality of lottery play slips and lottery tickets.

It is another object of this invention to provide a lottery play slip and lottery ticket jacket which is transparent for easy viewing of the contents and numbers contained thereon.

It is yet another object of this invention to provide a lottery play slip and lottery ticket jacket which is inexpensive to manufacture and is easily carryable in a purse or pocket of the lottery participant.

It is yet another object of this invention to provide a lottery play slip and lottery ticket jacket whose panel components may be separable for ease in removing and inserting quantities of both lottery play slips and lottery tickets.

In accordance with these and other objects which will become apparent hereinafter, the instant invention will now be described with reference to the accompanying drawings.

DETAILED DESCRIPTION OF THE INVENTION

Figures 1, 2, 3, 4, 5, 6, 7, 8:
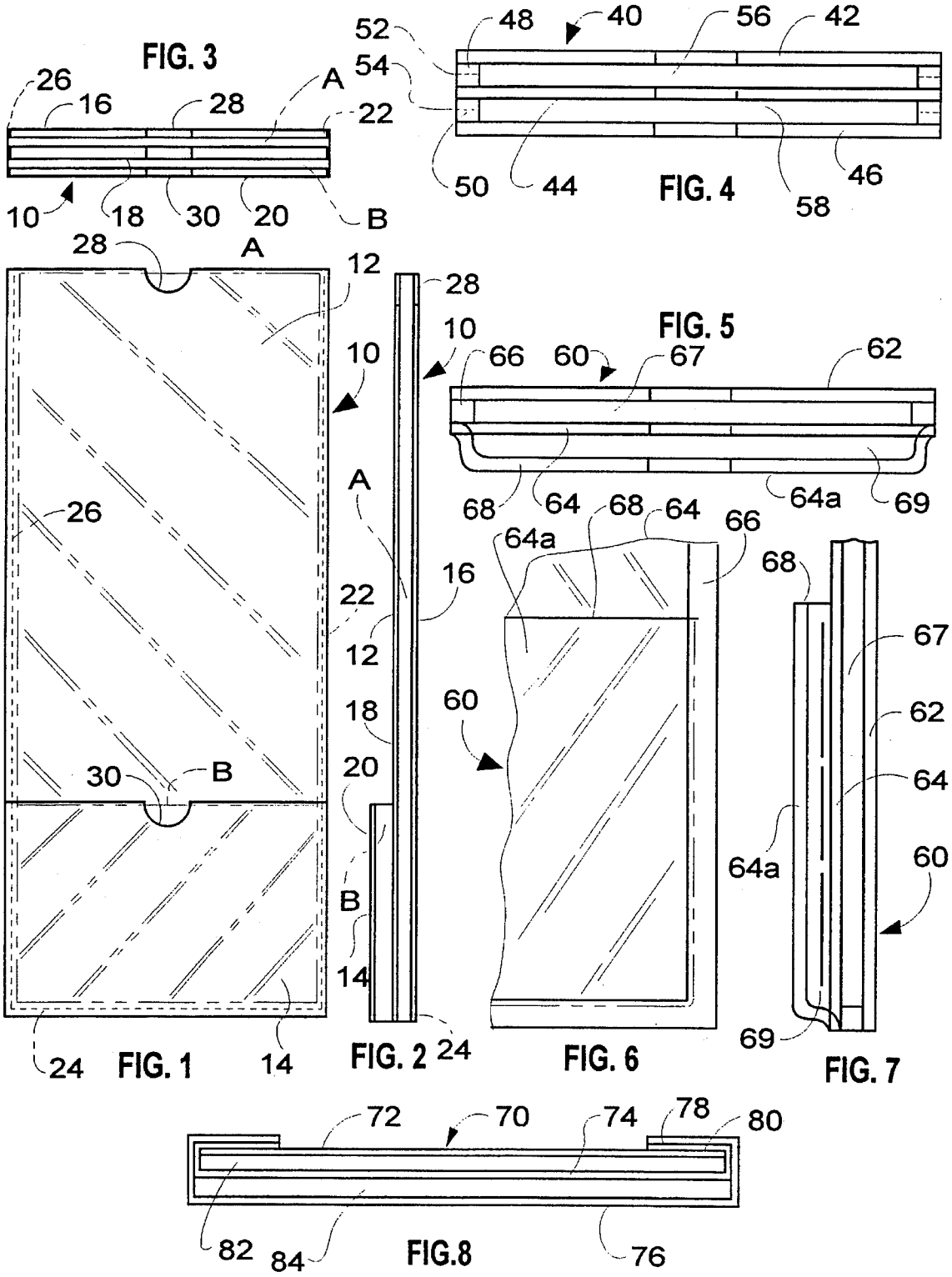
FIG. 1 is a front elevation view of the preferred embodiment of the invention.
FIG. 2 is a side elevation view of FIG. 1.
FIG. 3 is a top plan view of FIG. 1.
FIG. 4 is an enlarged top plan view of an alternate embodiment of the invention.
FIG. 5 is a top plan view of another embodiment of the invention.
FIG. 6 is a front elevation view of a lower portion of FIG. 5.
FIG. 7 is a side elevation view of FIG. 6.
FIG. 8 is a top plan view of yet another embodiment of the invention.

Referring now to the drawings, and particularly to FIGS. 1 to 3, the preferred embodiment of the invention is shown generally at numeral 10. This device 10 includes a transparent rear panel 16, a transparent middle or intermediate panel 18 sized identical to the rear panel 16, and a transparent front panel 20. These three panels 16, 18, and 20 are all formed of thin transparent plastic material having a preferred thickness of approximately 20 mils and connected along their longitudinal or upright margins at 22 and 26 and their lower or transverse margin 24 by either heat seal, stitching or the like.

These three panels 16, 18, and 20, connected in spaced apart relation adjacent one another as above described and shown, define two separate rectangular pockets 12 and 14. The longer pocket 12 is sized so that a lottery play slip, shown in phantom at A may be inserted between the back panel 16 and the middle panel 18, while the second pocket 14 is sized so that a conventional lottery ticket, shown in phantom at B, may be inserted between the lower portion of middle panel 18 and the front panel 20. To facilitate removal of both the lottery play slip A and the lottery ticket B, fingertip notches 28 and 30 are also formed into the upper margins of the respective panels.

It is a matter of design choice as to the spacing between each of the panels 16, 18, and 20 so as to accommodate either one or a plurality of each of the lottery play slips A and lottery tickets B. It is anticipated that these spacings should preferably accommodate between five and ten of each of the lottery play slips A and lottery tickets B.

By this arrangement, then, all of the lottery play slips A positioned within pocket 12 and all of the lottery tickets B positioned within pocket 14 are readily accessible and the top one of each of these being viewable through the transparent panels 18 and 20, respectively.

An alternate embodiment of the construction of the present invention is shown generally at numeral 40 in FIG. 4. This embodiment 40 includes rectangular transparent plastic panels 42, 44, and 46 sized as previously described with respect to the embodiment 10 shown in FIG. 1. However, these panels 42, 44 and 46 are held together by strips of double sided foam adhesive tape at 48 and 50. The thickness of this foam tape 48 and 50 determines the width of each of the pockets 56 and 58 for accommodating one or a plurality of lottery play slips A and lottery tickets B as previously described.

An alternate embodiment of FIG. 4 is shown in phantom at 52 and 54 wherein the adhesive foam strips 48 and 50 are replaced by strips of two-part hook and loop material so that the panels 42, 44, and 46 may be separated to facilitate both in searching and removal of quantities of each of the lottery play slips A and lottery tickets B.

In FIG. 5 to 7, yet another embodiment is there shown at numeral 60. This embodiment 60 includes a transparent rectangular rear plastic panel 62 and a similarly sized transparent middle panel 64 held in spaced apart relationship by foam double sided adhesive tape 66 to define play slip pocket 67. However, in this embodiment 60, the front panel 64*a* is formed integral with the middle panel 64 by slitting the middle panel 64 along transverse line 68 and then deforming the plastic material forwardly as shown to define the lottery ticket pocket 69.

Lastly, in FIG. 8, another embodiment is shown at numeral 70 formed of paper panels 72, 74, and 76 which are folded along their longitudinal and bottom margins, overlapped and adhered at 78 and 80 to define the lottery play slip pocket 82 and the lottery ticket pocket 84 as previously described in FIG. 1.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A jacket for viewably holding a lottery play slip and a lottery ticket jacket consisting of:

a first flat pocket sized similar to the lottery play slip and defined by generally coextensive mating rectangular middle and rear panels connected along each common side margin and a common first end margin of said middle and rear panels, the lottery play slip being insertable into said first pocket through a completely open second end thereof;

a second flat pocket sized similar to the lottery ticket, the lottery ticket being smaller in length than the lottery play slip, said second pocket defined by a lower surface of said middle panel and a front panel connected against said middle panel along each common side margin and a common first end margin of said front and middle panels, the lottery ticket being protectively insertable into said second pocket through a completely open second end thereof;

said front and middle panels being transparent for viewing the lottery play slip and the lottery ticket.

2. A jacket for viewably holding a lottery play slip and a lottery ticket jacket consisting of:

a front, middle and rear rectangular panel each formed of flat material having a width generally equal to a width of the lottery play slip and the lottery ticket, said middle and rear panels having a length generally equal to a length of the lottery play slip and said front panel, being somewhat shorter in length than said middle and rear panels, having a length generally equal to the lottery ticket;

all said panels connected against one another along each common longitudinal margin and a common lower margin thereof;

the play slip being protectively insertable between said middle and rear panels, the lottery ticket being protectively insertable between said front and middle panels;

said front and middle panels being transparent.

3. A jacket for viewably holding a lottery play slip and a lottery ticket jacket consisting of:

a first flat rectangular pocket means completely open at an upper end thereof for slidable insertion of, and close protective contact against, either side of the lottery play slip;

said first pocket means having an edge profile sized similar to that of the lottery play slip;

a second flat rectangular pocket means smaller than and connected against said first pocket means for slidable insertion of, and close protective contact against, either side of the lottery ticket;

said second pocket means having an edge profile sized similar to that of the play slip;

said first and second pocket means being transparent.

* * * * *